US007216798B2

(12) United States Patent
Stephens et al.

(10) Patent No.: US 7,216,798 B2
(45) Date of Patent: May 15, 2007

(54) MAILBOX SYSTEM

(75) Inventors: LaVerna Marie Stephens, Chesterfield, MI (US); Randy Scott Stephens, Chesterfield, MI (US)

(73) Assignee: Exclusive Products, LLC, Chesterfield, MI (US)

( * ) Notice: Subject to any disclaimer, the term of this patent is extended or adjusted under 35 U.S.C. 154(b) by 7 days.

(21) Appl. No.: 11/280,500

(22) Filed: Nov. 16, 2005

(65) Prior Publication Data

US 2006/0102711 A1 May 18, 2006

Related U.S. Application Data

(60) Provisional application No. 60/628,805, filed on Nov. 17, 2004.

(51) Int. Cl.
*A47G 29/12* (2006.01)

(52) U.S. Cl. ..... 232/39; 232/38; 232/1 C; 40/606.06; 248/146

(58) Field of Classification Search ..... 232/39, 232/17, 1 C, 38; D99/29–32; 248/146, 248/156, 151, 163.1, 163.2; 40/606.06; 116/173; 47/66.6

See application file for complete search history.

(56) References Cited

U.S. PATENT DOCUMENTS

| | | | | | |
|---|---|---|---|---|---|
| 730,806 | A | * | 6/1903 | Sword | 232/39 |
| 1,495,741 | A | | 5/1924 | Higdon, Jr. | |
| 1,602,711 | A | * | 10/1926 | Schneider | 248/134 |
| D91,836 | S | * | 3/1934 | Miller | D99/30 |
| 1,994,186 | A | * | 3/1935 | Anderson | 232/39 |
| D95,339 | S | * | 4/1935 | Hahn | D99/30 |
| 2,611,570 | A | * | 9/1952 | Kroll | 248/148 |
| 3,999,702 | A | * | 12/1976 | Conroy | 232/39 |
| 4,148,432 | A | * | 4/1979 | Cornwell, Jr. | 232/39 |
| 4,236,665 | A | * | 12/1980 | Glass | 232/39 |
| 4,709,853 | A | * | 12/1987 | Hahn | 232/39 |
| 5,903,991 | A | | 5/1999 | Sasse | |
| 6,513,284 | B1 | | 2/2003 | Sandlin | |
| D495,110 | S | | 8/2004 | Sarich | |
| 6,962,460 | B1 | * | 11/2005 | Pratt | 404/6 |
| 7,051,920 | B1 | * | 5/2006 | Asch | 232/39 |
| 7,080,773 | B1 | * | 7/2006 | Tepley | 232/17 |

* cited by examiner

*Primary Examiner*—William L. Miller
(74) *Attorney, Agent, or Firm*—Reising, Ethington, Barnes, Kisselle, P.C.

(57) ABSTRACT

A mailbox system that is sturdy and durable, easy to manufacture, assemble and customize, and is aesthetically pleasing to look at. The mailbox system preferably includes a pair of vertical posts and horizontal rails, a decorative component such as a flag or flower box, a mailbox and a newspaper receptacle. When assembled, the horizontal rails and the decorative component span between and are supported by the vertical posts, while the mailbox and newspaper receptacle are mounted to a single post. Assembly of the mailbox system is made quick and easy through the use of a series of snap-fit assembly features.

16 Claims, 2 Drawing Sheets

MAILBOX SYSTEM

CROSS-REFERENCE TO RELATED APPLICATION

This application claims the benefit of U.S. Provisional Patent Application No. 60/628,805 filed Nov. 17, 2004, the complete disclosure of which is hereby incorporated by reference.

TECHNICAL FIELD

The present invention relates generally to mailboxes, and more particularly, to mailbox systems for use with residential, commercial and/or other properties.

BACKGROUND OF THE INVENTION

It is not uncommon to see numerous types of mailboxes installed along streets, driveways, sidewalks, etc., particularly when driving through a neighborhood or housing development. These mailboxes can vary widely in appearance, construction, functionality and purpose, but usually include a vertical post and a horizontal rail supporting some type of mail-receiving receptacle. Some mailboxes are rather plain and utilitarian, while others are highly decorative and provide aesthetic as well as functional benefits.

Various types of mailboxes, mailbox systems, signposts, etc. have been developed, including the ones disclosed in U.S. Design Pat. No. D495,110 issued to Sarich on Aug. 24, 2004; U.S. Pat. No. 1,495,741 issued to Higdon on May 27, 1924; U.S. Pat. No. 5,903,991 issued to Sasse on May 18, 1999 and U.S. Pat. No. 6,513,284 issued to Sandlin on Feb. 4, 2003.

SUMMARY OF THE INVENTION

In accordance with one aspect of the present invention, there is provided a mailbox system that includes at least two vertical posts, a horizontal rail, a decorative component and a mailbox. The horizontal rail and decorative component extend between and are mounted to the vertical posts.

In accordance with another aspect of the present invention there is provided a signage assembly that includes at least two vertical posts, at least two horizontal rails and a decorative component. The horizontal rails and the decorative component extend between the vertical posts, and the horizontal rails and vertical posts connect to one another via a series of snap-fit assembly features.

In accordance with yet another aspect of the invention, there is provided a method of assembling a mailbox system.

Some objects, features and advantages of this invention include, but are certainly not limited to, providing a mailbox system for use with residential, commercial and/or other properties, and providing a design that is of relatively simple design, pleasing aesthetic appearance, economical manufacture and assembly, and has a long and useful life in service.

BRIEF DESCRIPTION OF THE DRAWINGS

These and other objects, features and advantages of the invention will be apparent from the following detailed description of the preferred embodiments and best mode, the appended claims and the accompanying drawings, in which:

DETAILED DESCRIPTION OF THE PREFERRED EMBODIMENTS

Figure 1:
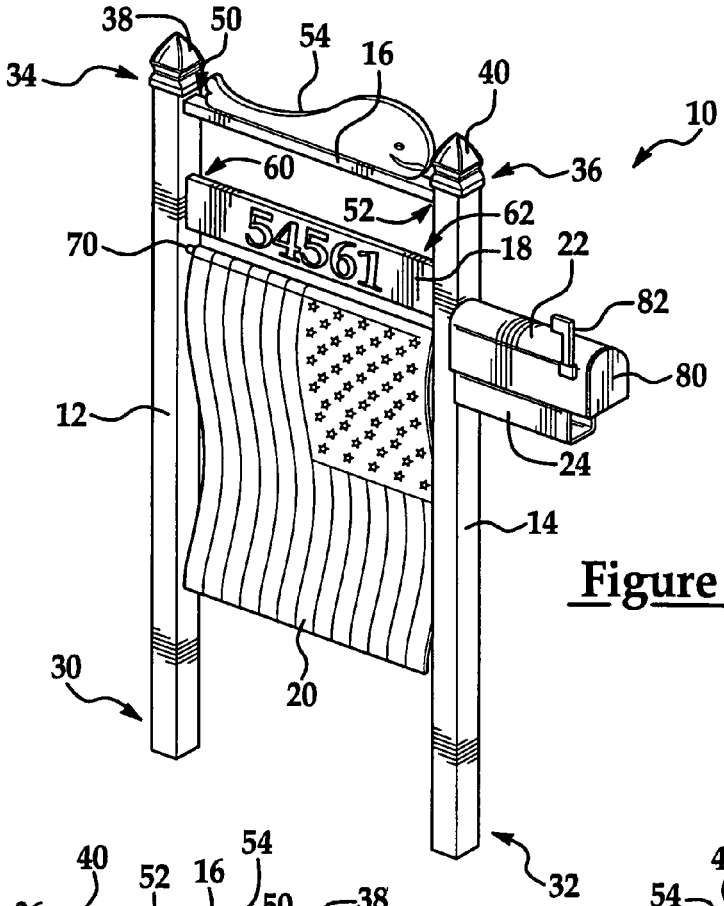
FIG. 1 is a perspective view of an embodiment of the mailbox system.
Figure 2:
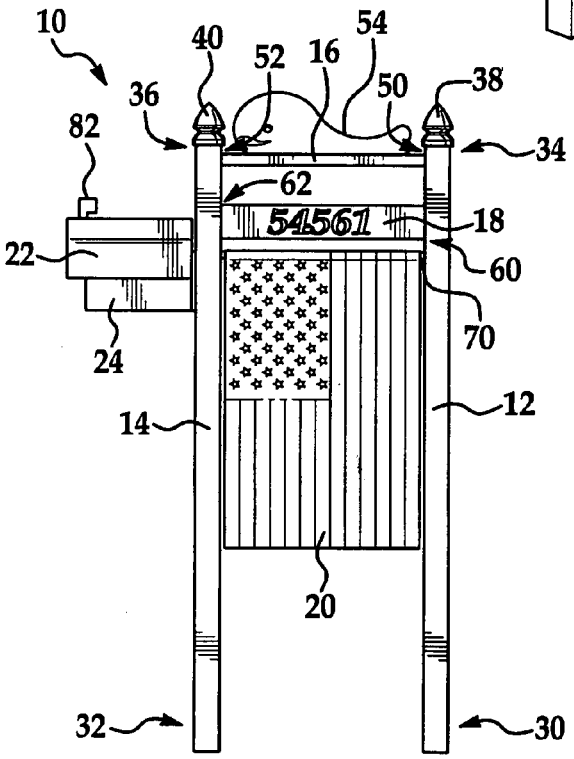
FIG. 2 is a side view of the mailbox system embodiment shown in FIG. 1.
Figure 3:
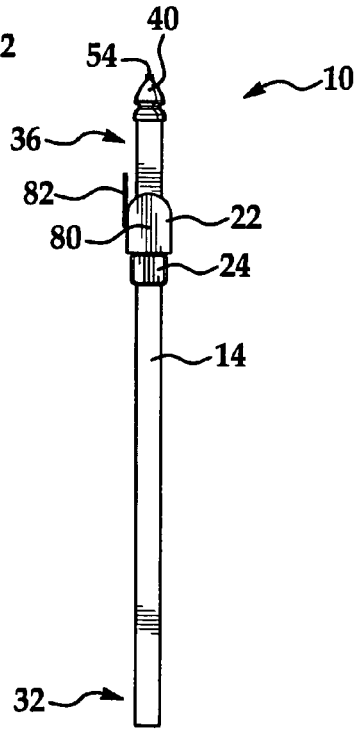
FIG. 3 is a front view of the mailbox system embodiment shown in FIG. 1.
Figure 4:
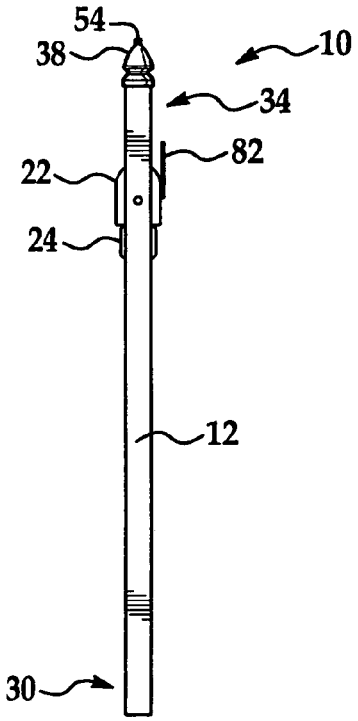
FIG. 4 is a rear view of the mailbox system embodiment shown in FIG. 1.

With reference to FIGS. 1–4, there is shown an embodiment of a mailbox system 10 that is sturdy and durable, easy to manufacture, assemble and customize, and is aesthetically pleasing to look at. Mailbox system 10 generally includes a pair of vertical posts 12 and 14, a pair of horizontal rails 16 and 18, a decorative component 20 such as a flag, a mailbox 22 and a newspaper receptacle 24.

Figure 5:
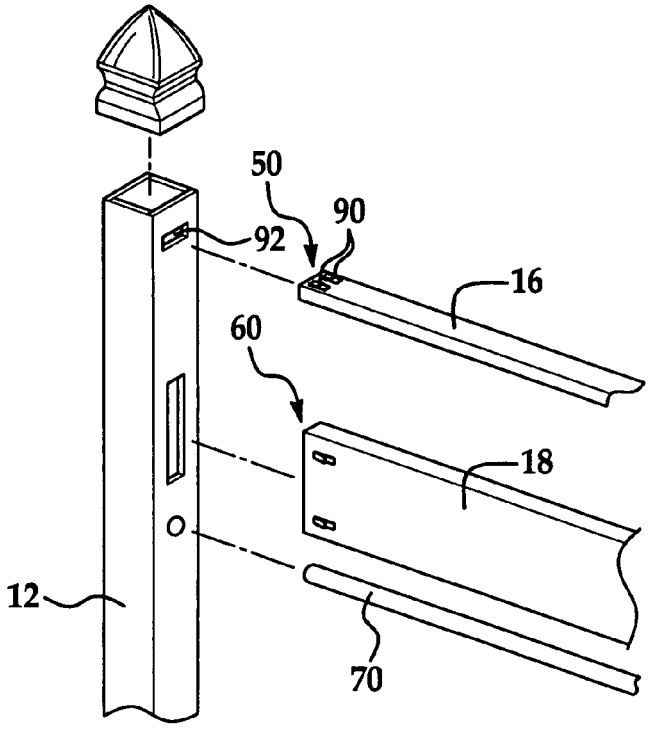
FIG. 5 is an enlarged view of a portion of the mailbox system embodiment of FIG. 1, which includes assembly features for connecting the horizontal rails to the vertical posts.

Vertical posts 12 and 14 are designed to support the other components of mailbox system 10, and each respectively includes a lower end 30, 32, an upper end 34, 36 and a series of assembly features, which are shown in FIG. 5 and described later. Vertical post 12 is largely the same as vertical post 14, thus, the following explanation of vertical post 12 applies equally to post 14, unless stated otherwise. According to a preferred embodiment, vertical post 12 is an elongated member having a hollow, rectangular cross-section (4"×4") and is made from a plastic or otherwise synthetic material, such as a PVC vinyl material where the PVC is co-extruded with recycled PVC. Lower end 30 can either be a squared off hollow end, as shown in the drawings, or it can be affixed with some type of sharp component for inserting it into the ground. Upper end 34 is preferably a squared off hollow end capable of receiving one of a number of post caps, including the decorative post caps 38 and 40 shown in the drawings. Other post caps such as ones that are spherical, gothic-themed or illuminated, to name but a few, can also be attached to upper ends 34 and 36, as the post caps are preferably interchangeable. In the case of illuminated post caps, the illumination can be powered by a standard electrical connection brought up through the hollow interior of the vertical posts, or by solar energy.

Horizontal rail 16 spans the distance between the two vertical posts 12, 14 and thus ensures a predetermined post spacing; in addition, rail 16 provides stability and structural integrity to the overall assembly. Like the vertical posts, horizontal rail 16 is preferably made from a plastic material, such as a PVC vinyl, and is hollow throughout its length. According to the embodiment shown here, horizontal rail 16 is a generally flat, elongated member having a first end 50, a second end 52, and a hollow, rectangular cross-section. Horizontal rail 16 is arranged in a flat orientation, as opposed to the on-end orientation of rail 18, such that its wider dimension is facing upwards. This flat orientation allows the horizontal rail to better support one or more ornaments 54, as there is more surface area for the ornament to rest on. Of course, the decorative whale ornament 54 shown here could be replaced with one of a number of other ornaments, including business or family name plates, or it could be omitted altogether. Each of the ends 50 and 52 of horizontal rail 16 has assembly features that provide for easy connection with vertical posts 12 and 14; the assembly features are shown in FIG. 5 and are subsequently explained in greater detail.

Horizontal rail 18 is preferably the same length as rail 16, and is also a generally flat, elongated member made of a plastic material. However, rail 18 is arranged according to on-end orientation such that it can clearly display indicia of the owner's choice. Though it is not necessary, the combination of the 'flat' orientation of rail 16 and the 'on-end' orientation of rail 18 provides additional structural integrity to the overall mailbox system 10. Horizontal rail 18 connects with the vertical posts via a set of assembly features, which will be described later, and includes a first end 60, a second end 62, and a hollow rectangular cross-section.

The decorative component 20 shown here is an American flag mounted on a flagpole, but could be another flag or decorative component altogether. Flag 20 is supported by a horizontally-aligned flag pole 70 which, according to a preferred embodiment, is a commonly available dowel rod that is inserted through holes in vertical posts 12 and 14. Additional features like a cotter pin could be used to prevent flag pole 70 from being inadvertently backed out of the holes in the vertical posts. Moreover, it is preferable that the spacing between vertical posts 12 and 14 and the height of flagpole 70 off of the ground be such that it accommodates conventionally sized flags (usually 30" in width) so that the flag is flown properly and does not touch the ground. Inconspicuous lighting could be added to the inward facing sides of vertical posts 12 and 14 such that they illuminate decorative component 20; this is particularly desirable when decorative component 20 is a flag.

Mailbox 22 is preferably a standard size mailbox having a hinged door 80 and a mail indicator 82, and is mounted on newspaper receptacle 24 with a series of screws or other fasteners. Newspaper receptacle 24 is generally a hollow, square cross-sectioned receptacle that is sized to receive newspapers, circulars, magazines, catalogues, etc. In order to attach the newspaper receptacle and the mailbox to vertical post 14, an L-bracket (not shown) is screwed to the vertical post. Screws through the vertical and/or horizontal legs of this L-bracket retain newspaper receptacle 24, which in turn supports mailbox 22. Of course, other attachment components and/or methods known to those skilled in the art could be used to attach the mailbox and newspaper receptacle to vertical post 14.

According to a preferred assembly method, the various elements of mailbox system 10 are first put together and then the assembled mailbox system is inserted into pre-dug holes in the ground. It should of course be understood that mailbox 22, decorative ornament 54, and other components could be installed on the mailbox system after it has been partially put together and inserted into the ground. Horizontal rail 16 is connected to vertical posts 12 and 14 via a series of snap-fit attachment features, as shown in FIG. 5, which include resilient ears 90 and an elongated slot 92. Ears 90 can extend outwardly from one or more surfaces of horizontal rail 16 and are resilient so that they can be depressed when first end 50 of the horizontal rail is being inserted into slot 92. Once first end 50 has been inserted far enough into the slot, the ears are no longer constrained by the dimensions of the slot and accordingly resume their normal, non-depressed state. The rear interior wall of vertical post 12 prevents first end 50 from being inserted any further into the post. In order to disassemble horizontal rail 16, one can simply reach into the hollow interior of vertical post 12 and depress ears 90 so that first end 50 can be backed out of slot 92. Similar snap-fit arrangements are used to attach the following: second end 52 of horizontal rail 16 to vertical post 14, first end 60 of horizontal rail 18 to vertical post 12, and second end 62 of horizontal rail 18 to vertical post 14.

After the horizontal and vertical members have been assembled, flagpole 70 is inserted through holes in vertical posts 12 and 14 and flag 20 is hung. Those holes can extend completely through vertical posts 12 and 14, or can simply extend into the hollow cavity of the posts. The newspaper receptacle 24 is attached to vertical post 14 via an L-bracket, and mailbox 22 is screwed to the newspaper receptacle. The assembled mailbox system 10 is then inserted into pre-dug holes and is secured in place, possibly through the use of cement, sand, dirt, etc.

Figure 6:
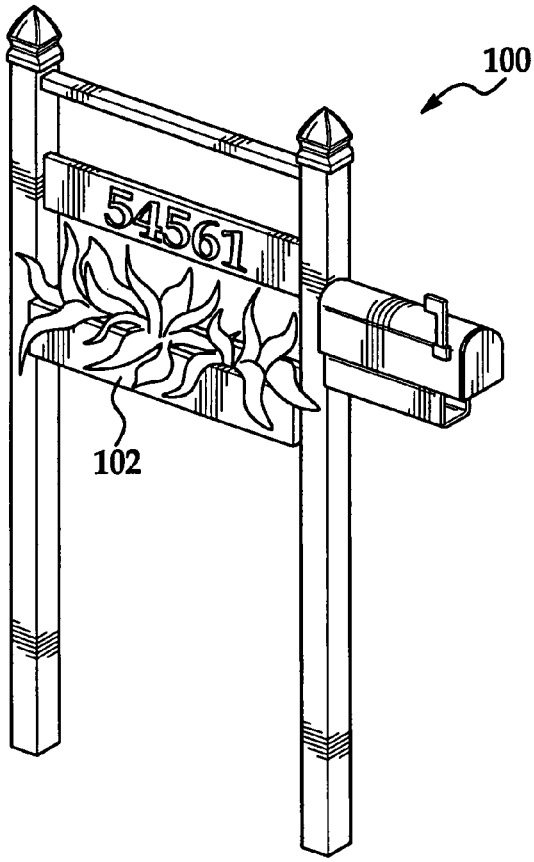
FIG. 6 is a perspective view of another embodiment of the mailbox system.

According to another embodiment shown in FIG. 6, mailbox system 100 includes a flowerbox 102 as a decorative component, in place of the flag and flagpole. Like the horizontal rails, flowerbox 102 is sized to properly space the vertical posts, and is sturdy enough to support the additional weight of soil, flowers, water, etc. If necessary, the attachment features that attach flowerbox 102 to the vertical posts could be strengthened through the use of L-brackets or other fasteners known to those skilled in the art.

It will thus be apparent that there has been provided in accordance with the present invention a mailbox system, as well as a method of assembly which achieve the aims and advantages specified herein. It will of course be understood that the foregoing description is of preferred exemplary embodiments of the invention and that the invention is not limited to the specific embodiments shown.

For instance, the mailbox system could include two or more decorative components 20, including the following combinations: a flowerbox and a flag, two flowerboxes (parallel horizontal alignment, one on top of the other), and two flags. An additional hanging flower bracket or flowerbox could be mounted to either of the vertical posts such that instead of spanning between the two posts, it is simply mounted to one of them. It is also possible for the vertical posts and horizontal rails of the mailbox system to be made of materials other than PVC, such as wood (softwoods, hardwards, recycled wood products, etc.), metal (galvanized metal, sheet metal, steel, copper, aluminum, etc.), and other plastic or synthetic materials (other plastics, recycled materials, etc.) Moreover, the mailbox and newspaper receptacle could be removed from the assembly altogether, such that the assembly functioned simply as an advertisement, signage or decorative object. Also, it is possible to provide a mailbox system where a horizontal rail extends beyond the two vertical posts such that it not only spaces and stabilizes the two vertical posts, but it also provides a support on which the mailbox and/or the newspaper receptacle can be mounted. Various changes and modifications will become apparent to those skilled in the art and all such variations and modifications are intended to come within the scope of the appended claims.

As used in this specification and claims, the terms "for example", "for instance" and "such as," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A mailbox system, comprising:

at least two vertical posts;

a horizontal rail;

a decorative component; and a mailbox mounted to one of said vertical posts such that said mailbox extends from its rear end to its mail-receiving front end in a direction away from at least two vertical posts, wherein said horizontal rail and said decorative component extend between and are mounted to said vertical posts.

2. The mailbox system of claim 1, wherein each of said vertical posts is generally an elongated, hollow member having a rectangular cross-section.

3. The mailbox system of claim 1, wherein each of said vertical posts is affixed with a decorative, interchangeable post cap.

4. The mailbox system of claim 1, wherein said horizontal rail is generally an elongated hollow member having a rectangular cross-section.

5. The mailbox system of claim 1, wherein said horizontal rail has at least one ornament attached thereto.

6. The mailbox system of claim 1, wherein said system includes a second horizontal rail that extends between and is mounted to said vertical posts.

7. The mailbox system of claim 6, wherein said second horizontal rail displays some type of indicia.

8. The mailbox system of claim 6, wherein said horizontal rail is aligned according to a generally flat orientation, and said second horizontal rail is aligned according to a generally on-end orientation.

9. The mailbox system of claim 1, wherein said decorative component includes a flag and flagpole.

10. The mailbox system of claim 9, wherein the spacing between said vertical posts is approximately 30 inches in width.

11. The mailbox system of claim 1, wherein said decorative component includes a flower box.

12. The mailbox system of claim 1, wherein said mailbox is mounted to said one of said vertical posts via a newspaper receptacle.

13. The mailbox system of claim 1, wherein said system includes snap-fit attachment features for connecting said horizontal rail between said vertical posts.

14. The mailbox system of claim 1, wherein said vertical posts and said horizontal rail are comprised of at least one of the following materials: wood, metal and plastic.

15. A method of assembling a mailbox system, comprising the steps of:

(a) providing at least two vertical posts each having an assembly feature, a horizontal rail having an assembly feature, a decorative component, and a mailbox;

(b) attaching said horizontal rail to said vertical posts via said assembly features such that said horizontal rail extends between said vertical posts;

(c) attaching said decorative component to said vertical posts such that said decorative component extends between said vertical posts, and (d) mounting said mailbox such that it is supported by at least one of said vertical posts extends from its rear end to its mail-receiving front end in a direction away from said at least two vertical posts.

16. The method of claim 15, wherein step (d) further includes providing a newspaper receptacle, wherein said newspaper receptacle is attached to said one of said vertical posts and said mailbox is in turn attached to said newspaper receptacle.

* * * * *